United States Patent [19]

Green

[11] 4,157,596

[45] Jun. 12, 1979

[54] MOTOR-TENDER LIFT

[76] Inventor: Thomas A. Green, 10880 Norum Crescent, Delta, British Columbia, Canada, V4C 3H7

[21] Appl. No.: 876,621

[22] Filed: Feb. 10, 1978

[51] Int. Cl.[2] ..... B63B 23/02

[52] U.S. Cl. ..... 9/34

[58] Field of Search ..... 114/258, 259, 230; 9/30, 31, 33, 34; 296/23 B

[56] References Cited

U.S. PATENT DOCUMENTS 3,143,991 8/1964 Anderson ..... 9/34

*Primary Examiner*—Trygve M. Blix

*Assistant Examiner*—James B. Bechtel

*Attorney, Agent, or Firm*—Fulwider, Patton, Rieber, Lee & Utecht

[57] ABSTRACT

An apparatus for moving an outboard motor between a storage position adjacent a mother vessel and an operational position on a small boat floating generally adjacent the mother vessel. The apparatus comprises a mount for the outboard motor connectable to the small boat, a lifting arm connectable to the mother vessel at one end and connectable to the mount at the second end, and a mechanism for lifting the lifting arm from a lowered position to a raised position and for lifting the mount from the operational position to the storage position when the mount is connected to the lifting arm.

13 Claims, 10 Drawing Figures

Fig. 1.
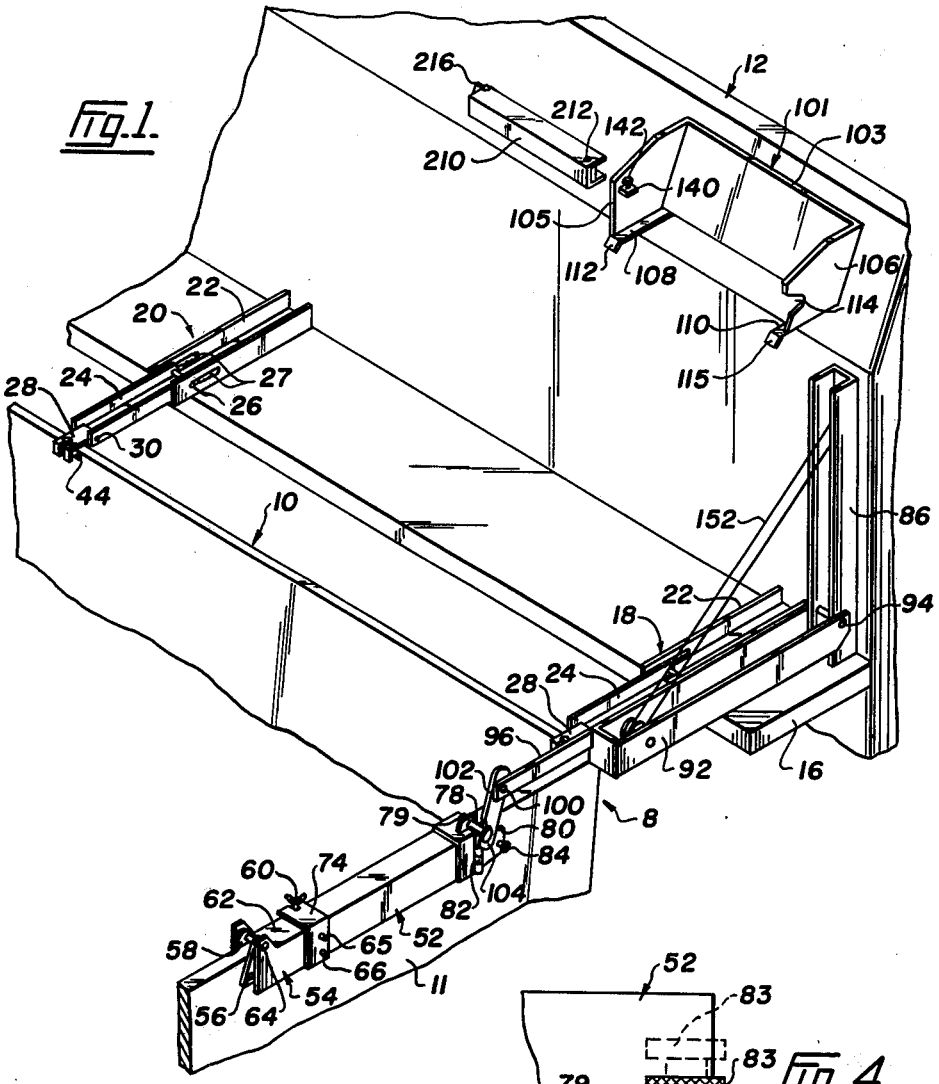
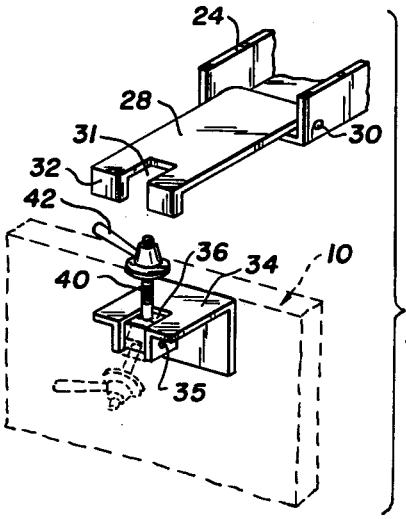
Fig. 3.
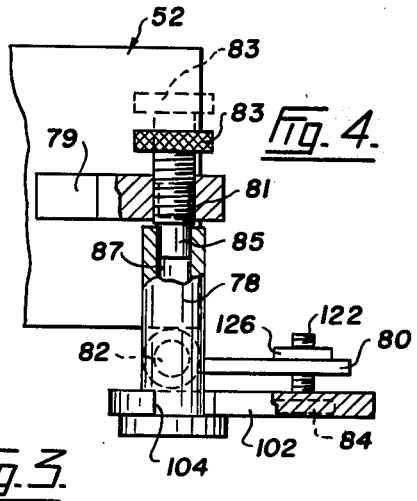
Fig. 4.

Fig. 2.
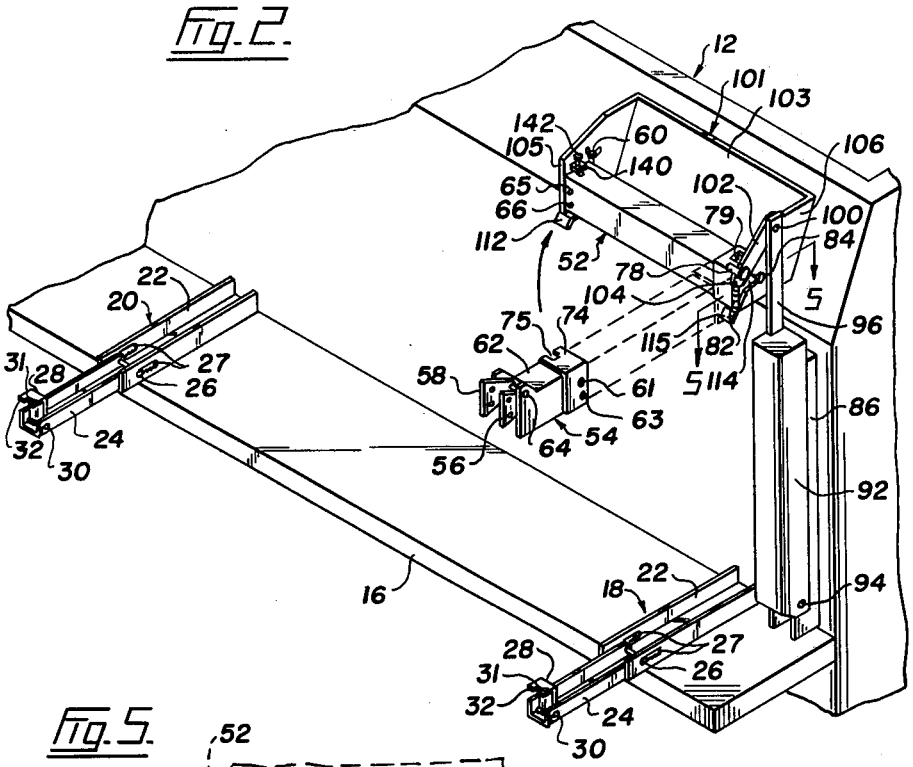
Fig. 5.
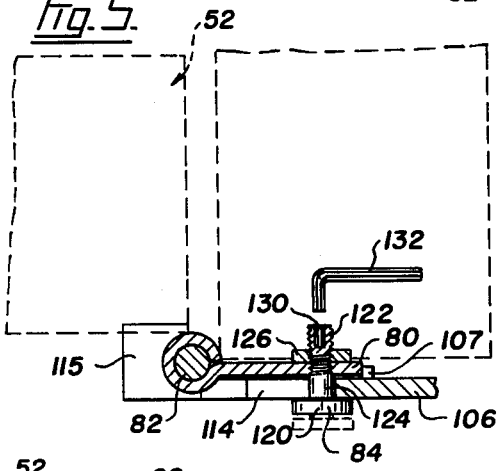
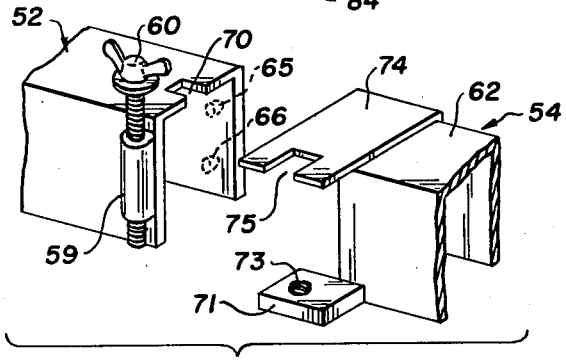
Fig. 6.

10
200
64
56
54
52
102
96
92
152
94
16
100
28
30
8
24
26
27
22
11
12
101
106
114
115
86

12
101
106
114
115
96
154
152
150
156
169
162
158
164
86
92
94
16

12
106
101
114
115
96
86
92
184
182
174
170
176
172
94
180
178
16

MOTOR-TENDER LIFT

BACKGROUND OF THE INVENTION

This invention relates to an apparatus for moving an outboard motor between a storage position adjacent a mother vessel and an operational position on a small boat floating generally adjacent the mother vessel.

With a larger motor powered pleasure craft, it is desirable to have a smaller boat or tender with the craft for communicating to and from anchorage and for other relatively short excursions. It is well known to carry the small boat in a storage position against the stern of the mother craft. For example, in U.S. Pat. No. 3,143,991 to Anderson, a mechanism is disclosed for raising the small boat from a position floating astern the mother craft to a storage position against the stern of a mother craft. The mechanism consists of articulated arms and hinged connections whereby the small boat may be lifted upwards and rotated rotated through an angle of 90° from the water to the storage position. Today, many boaters find it highly desirable to carry an outboard motor for the small boat or tender. A mechanism, such as disclosed by Anderson, makes no provision for the outboard motor. It is both awkward and unsafe to attempt the removal of the outboard motor from the small boat, and the lifting of outboard motor to a suitable position for storage, while the small boat is floating in the water.

SUMMARY OF THE INVENTION

According to this invention, there is provided an apparatus for simultaneously moving an outboard motor and a small boat between a storage position generally against a mother vessel and an operational position floating generally adjacent the mother vessel, the apparatus comprising: a mount for the outboard motor; first connecting means for pivotally connecting the mount to the small boat; lifting arm means having a proximal end and a distal end and pivotally connectable to the mother vessel near the proximal end; second connecting means near the distal end of the lifting arm means for pivotally connecting the lifting arm means to lifting the mount; and means for lifting the lifting arm means from a lowered position to a raised position and for the mount from the operational position to the storage position when the mount is connected to the lifting arm.

The invention overcomes the difficulties connected with removing an outboard motor from a small boat or tender floating adjacent a mother vessel and securing the motor in a storage position on the mother vessel. In one simple operation, the small boat may be lifted from the water to the storage position against the stern of the mother vessel while the outboard motor is lifted from the stern of the small boat to a storage position against the stern of the mother vessel. It is important to note that the outboard motor is lifted in a upright orientation from the stern of the small boat to the storage position against the stern of the mother vessel. No manual manipulation of the motor is required at any time. The motor is easily secured to a bracket or the like and attached to the stern of the mother vessel with minimum effort. Various means may be used for lifting the outboard motor and boat from the operational position to the storage position, such as a winch and cable or a hydraulic cylinder. Either manual or power operation is suitable.

In drawings which illustrate embodiments of the invention:

FIG. 1 is an isometric view showing the stern of a mother vessel and a small boat with an apparatus for moving the small boat, and an outboard motor mounted on the small boat, to a storage position against the stern of the mother vessel;

FIG. 2 is an isometric view similar to FIG. 1 but showing the apparatus in the raised position and without the small boat;

FIG. 3 is an isometric view showing a portion of the small boat and a portion of a connector for connecting the small boat to the mother vessel;

FIG. 4 is an enlarged plan view, partly in section, showing the end of the motor mount of the apparatus shown in FIG. 1 and the means connecting the mount to the lifting arm;

FIG. 5 is a sectional view, taken along section 5—5 of FIG. 2, showing the bolt and wrenches used to secure the motor mount to the bracket on the stern of the mother vesssel;

FIG. 6 is an isometric view showing a portion of the motor mount and a portion of the pivoting connector for connecting the motor mount to the small boat;

DESCRIPTION OF THE PREFERRED EMBODIMENTS

Figure 7:
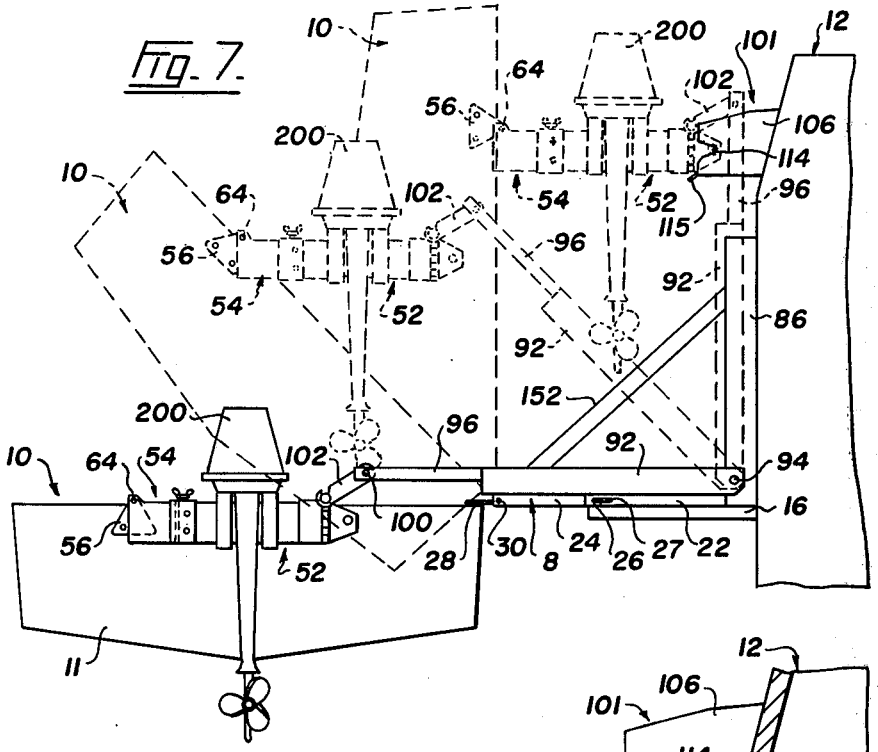
FIG. 7 is a side elevational view of the apparatus shown in FIGS. 1 and 2 and showing the apparatus in the operational position, the storage postion and in a position between the operational position and the storage position.

FIG. 1 shows the general arrangement of an apparatus 8 for lifting a small boat 10 and a outboard motor from an operational position to a storage position against the stern of a mother vessel 12, according to an embodiment of the invention. The small boat 10 is shown in a position floating generally aft of the mother vessel 12 with the gunwale of the small boat 10 generally parallel to the stern of the mother vessel 12. The mother vessel 12 is equipped with a swim grid 16 generally at the water line to the stern of the mother vessel 12, although this is not essential for the invention. When the small boat 10 is in the position shown, it may be connected to the mother vessel 12 by boat connectors 18 and 20. Boat connectors 18 and 20 each has a channel-shaped portion 22 fixedly attached to the swim grid 16 by bolts or the like. A channel-shaped arm 24 of each of the boat connectors 18 and 20 has one end pivotally attached to the fixed portion 22 by a pin 26. Pin 26 is positioned within a pair of elongate slots 27 in channel-shaped portion 22. Slots 27 have a series of concave depressions along their bottom edges for receiving pin 26 in different positions.

As seen in FIG. 3 for bracket 18, the other end of arm 24 is pivotally connected to one end of attachment finger 28 by pin 30. The other end of attachment finger 28 has a slot 31 and a ridge 32 for attaching the attachment finger 28 to a bracket 34 on the small boat 10. The bracket 34 has a slot 36 corresponding to the slot 31 on attachment plate 28. The ridge 32 on attachment finger 28 is for projecting over the bracket 34. A bolt 40, pivotally connected to bracket 34 by pin 35, passes through slots 31 and 36 and wing nut 42 is tightened on bolt 40 to secure the attachment finger 28 to the bracket 34. Boat connector 20 is similar in construction to boat connector 18 and will not be described in detail. Boat connector 20 is attachable to bracket 44 of the small boat 10 in a manner similar to the attachment of connector 18 to bracket 34.

The apparatus for lifting an outboard motor from the stern of the small boat 10 to a storage position on the stern of the mother craft 12 is indicated generally at 8. The apparatus 8 includes a channel-shaped motor mount 52 for fitting on the stern 11 of the small boat 10. As shown in FIG. 1, a first end of the motor mount 52 is connected to pivoting connector 54.

Pivoting connector 54 has attachment plates 56 and 58 for fitting on each side of the stern 11 of the small boat 10. Suitable fasteners, such as screws, are driven through plates 56 and 58 into the stern of the small boat for securing pivoting connector 54 to the stern 11. Pivoting connector 54 also has a short channel-shaped section 62 pivotally connected to plates 56 and 58 by a pin 64. The pin 64 allows channel-shaped section 52 to pivot away from the stern 11 of the small boat 10 as seen in FIG. 7.

Motor mount 52 may be connected to pivoting connector 54 as illustrated in FIG. 1. Referring to FIG. 6, a bolt 60 is provided with a corresponding threaded sleeve 59 welded to the side of motor mount 52 in the upright position near the end closest to pivoting connector 54. The bolt 60 is provided with a winged head for turning the bolt 60 within sleeve 59. Two bullet-shaped projections 64 and 66 are welded to the side of motor mount 52 opposite bolt 60. Angular plate 74 is welded to the end of pivoting connector 54 closest to motor mount 52 along the side of pivoting connector 54 corresponding to the side of motor mount 52 having projections 65 and 66 and along the top of pivoting connector 54. A pair of apertures 61 and 63, as shown in FIG. 2, are provided in angular plate 74 corresponding in size and position to projections 65 and 66 on motor mount 52. The top of angular section 74 projects over the side of pivoting connector 54 corresponding to the side of motor mount 52 having sleeve 59. This end of angular plate 74 is provided with a slot 75 greater in size than the cross section of bolt 60. A flat tab 71 is welded to the bottom of pivoting connector 54 below slot 75 and has a threaded aperture 73. In order to connect pivoting connector 54 to motor mount 52, angular plate 74 is placed over the end of motor mount 52 so projections 65 and 66 pass through apertures 61 and 63 respectively and the top of bolt 60 projects through slot 75. Bolt 60 is then threaded through aperture 73 and tightened against angular plate 74 to provide the connection as shown in FIG. 1.

As seen in FIG. 4, a flat-headed pin 78 is welded to hinge 82 at the top of motor mount 52 near the end opposite pivoting connector 54. Tab 79 with threaded aperture 81 is welded to the top of motor mount 52. Thumb screw 83 with untapped end 85 is threaded through aperture 81. Untapped end 85 of screw 83 is receiveable with hollow end 87 of pin 78. Hinge 82 connects hinged section 80 to the remaining part of motor mount 52.

As seen in FIG. 1, the apparatus 8 has an upright member 86 fixedly attached, by bolts or the like, to the stern of the mother vessel 12 above the swimming grid 16. Upright member 86 has a generally channel-shaped cross section. Apparatus 8 also has a lifting arm 92, shown in the horizontal position in FIG. 1. The end of lifting arm 92 proximal the stern of the mother vessel 12 is pivotally connected near the bottom of upright member 86 by a pin 94. Lifting arm 92 is pivotable about pin 94 between the generally horizontal position shown in FIG. 1 and a generally vertical position generally in alignment with upright member 86, as shown in FIG. 2. Lifting arm 92 also has a bar 96 welded at the end distal the pin 94. A pin 100 pivotally connects bar 96 to one end of the link 102. The other end of link 102 has a hook 104 for engaging pin 78 of motor mount 52, previously described. As seen in FIG. 1, when motor mount 52 is connected to pivoting connector 54 and the hook 104 is connected to the pin 78 of motor mount 52, the motor mount 52 is pivotal relative the stern 11 of the small boat 10 about pin 64 and also pivotal relative to link 102 about pin 78. Link 102 is pivotal relative to bar 96 about pin 100, and lifting arm 92 is pivotal relative to the stern of the mother vessel 12 about pin 94. All of the pivotal connections just mentioned allow for pivoting in a generally vertical plane passing through motor mount 52 and lifting arm 92. As shown in FIG. 7, these pivotal connections permit motor mount 52 remain generally horizontal when the lifting arm 92 is pivoted upwards about pin 94 from the generally horizontal position. At the same time, the small boat 10 is pivoted upwards generally through 90° on boat connectors 18 and 20. The pivoting occurs about pins 30 of the boat connectors 18 and 20.

The apparatus 8 also includes a bracket 101 as shown in FIGS. 1, 2 and 7. The bracket 101 has a back plate 103 attached to the stern of the mother vessel 12 by screws or other suitable means generally adjacent the top of upright member 86. Arms 105 and 106 of bracket 101 are attached to the back plate 103 and project generally 90° from the stern of the mother craft 12. Guides 108 and 110 are welded along the bottoms of arms 105 and 106, providing generally horizontal surfaces. Guides 108 and 110 have forwardly slopping portions 112 and 115 respectively at the ends distal the stern of the mother vessel 12. The end of arm 106 distal the stern of the mother vessel 12 has a V-shaped slot 114 for receiving the pin 84 of hinged portion 80 of motor mount 52. As best seen in FIGS. 2 and 5, when lifting arm 92 is in the vertical position, pin 84 is received at the end V-shaped slot 114 closest to the stern of the mother vessel 12. As seen in FIG. 5, pin 84 has a head 120 and a threaded portion 122 on a shank 124. A nut 126 is welded on the side of hinged portion 80 of motor mount 52 distal arm 106. Nut 126 is for receiving the threaded portion 122 of the pin 84. The shank 124 of the pin 84 is countersunk with a bore 130 os hexagonal cross section, at the end opposite head 120, for receiving an allen wrench 132 as shown in FIG. 5. When lifting arm 92 is in a vertical position and pin 84 is fully received within V-shaped slot 114, as shown in FIG. 2, the head 120 of pin 84 is tightened against arm 106 of bracket 101 by use of the allen wrench 132. Arm 106 has a stop 107 for hinged portion 80 of motor mount 52 as shown in FIG. 5.

After the end of motor mount 52 has been secured to arm 106 of bracket 101 by means of tightening pin 84, the other end of motor mount 52 may be disconnected from pivoting connector 54 by loosening wing nut 60 on stud 59 as shown in FIG. 6. Pivoting connector 54 is swung away from stud 59 and projections 65 and 66. Motor mount 52 can then be rotated 90° about hinge 82 to the position shown in solid lines in FIG. 2. As shown in FIG. 6, a slot 70 is provided in the top of motor mount 52 adjacent stud 59. A tab 140 is welded to the side of arm 105 of bracket 101 and is provided with a bolt 142. When motor mount 52 is swung to the position shown in solid lines in FIG. 2, bolt 142 may be tightened so that it projects through slot 70 and holds motor mount 52 securely in the position parallel to the stern of the mother vessel 12. Of course, in normal use, an outboard motor, such as outboard motor 200 of FIG. 7, is attached to motor mount 52 when secured adjacent the stern of the motor vessel.

Figure 8:
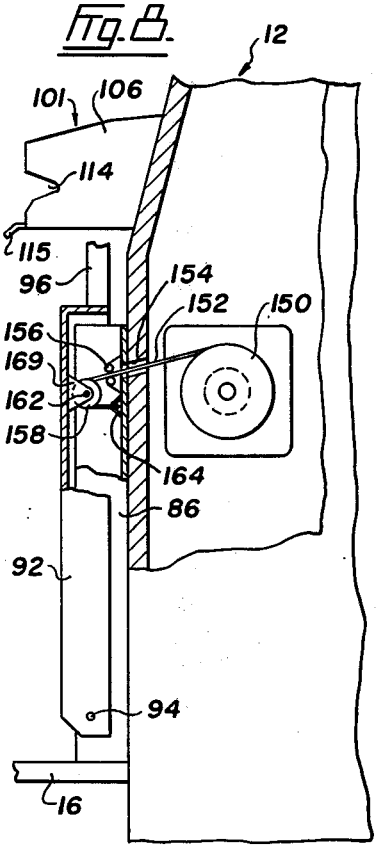
FIG. 8 is a partly broken-away elevational view of a winch and cable used to raise the mechanism from the lowered position to the raised position.
Figure 9:
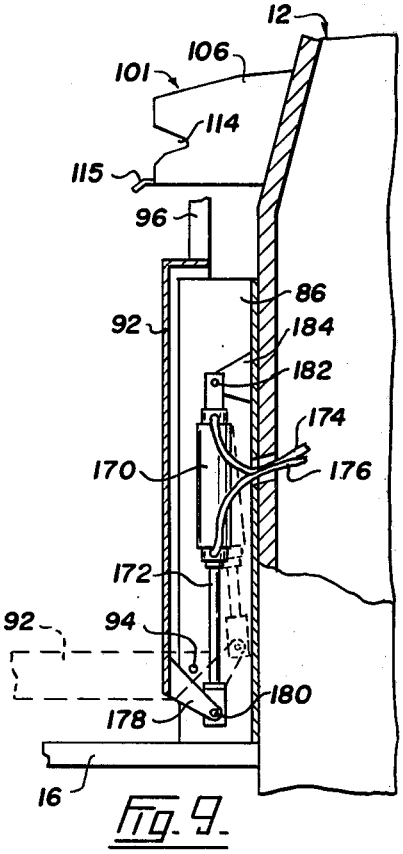
FIG. 9 is a partly brokenaway elevational view of an alternative hydraulic mechanism for raising the apparatus from the lowered position to the raised position.

FIGS. 1, 8 and 9 illustrate alternative means for moving lifting arm 92 from the position shown in FIG. 1 to the vertical position as shown in FIG. 2. For the embodiment shown in FIGS. 1 and 8, an electrically powered winch 150 is positioned within the mother craft 12. A cable 152 is attached to the winch and passes through an aperture 154 in the stern of the mother vessel 12. Guide rollers 156 are provided adjacent aperture 154 on stern 12. A guide pulley 158 is pivotally connected to tab 169 on lifting arm 92 by pin 162. A hook 164 is secured to upright member 86 located on the stern of the mother vessel 12 just below the aperture 154. One end of the cable 152 is attached to the hook 164. The cable passes through guide rollers 156, through pulley 158, and through aperture 154 to winch 150. It may easily be appreciated that lifting arm 92 can be lowered or raised by winding or unwinding the cable 152 from winch 150.

In the embodiment shown in FIG. 9, hydraulic cylinder 170 with a piston rod 172 is used for lowering or raising the lifting arm 92. Hydraulic lines 174 and 176 connect oppposite ends of the cylinder 170 to a hydraulic pump (not shown) located within the mother vessel 12. A crank arm 178 is welded to lifting arm 92 generally adjacent pin 94 and projects rearwardly of pin 94 when arm 92 is in the upright position as shown in FIG. 7. The end of piston rod 172 is pivotally connected to crank 178 by pin 180 located rearwardly and below pin 94 as shown in FIG. 7. The top of cylinder 170 is pivotally connected to the stern of the mother vessel by pin 182 and lug 184. In order to lower arm 92 from the position shown in FIG. 7, hydraulic fluid is added to cylinder 170 through hydraulic line 176 and withdrawn through hydraulic line 174, causing the piston (not shown) in cylinder 170 to rise and shorten the exposed portion of rod 172; pin 180 rotates about pin 94 counterclockwise from the point of view of FIG. 7 and lifting arm 92 is consequently lowered to the position shown in dotted lines. To raise lifting arm 92 from the position shown in FIG. 1, hydraulic fluid is added through hydraulic line 174 and removed through hydraulic line 176, moving the piston downwards and extending rod 172 from the cylinder 170. Pin 180 is rotated about pin 94 in the clockwise direction, from the point of view shown in FIG. 7, and lifting arm 92 is raised.

Figure 10:
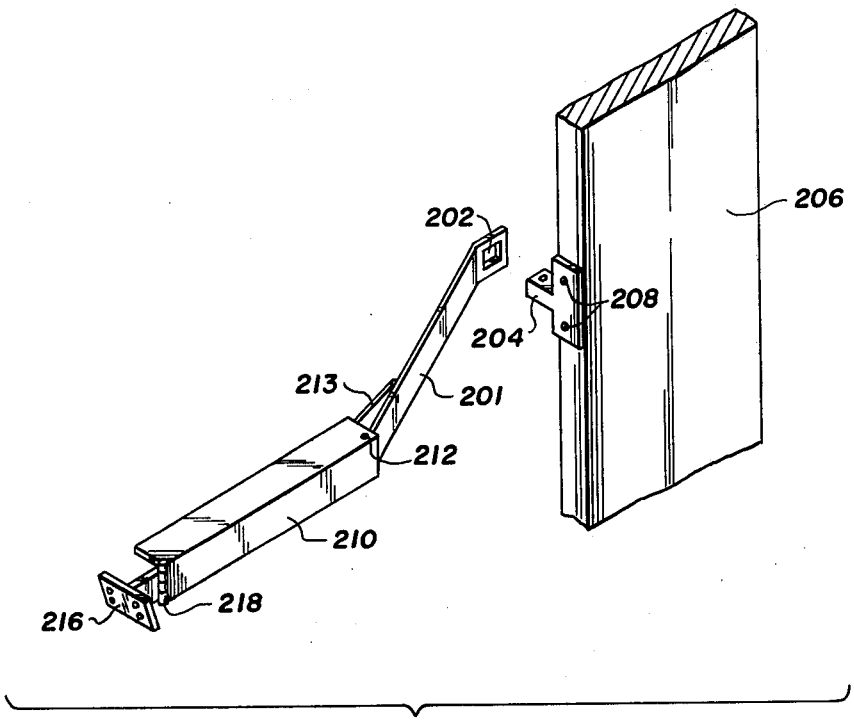
FIG. 10 is an isometric view of a small boat retaining strap and a portion of the small boat seat.

The operation of the present invention is relatively simple and may be summarized as follows: When the small boat 10 is in normal use, an outboard motor 200 is attached to the motor mount 52 on the stern 11 of the small 10, as shown in FIG. 7. When it is desired to put a small boat 10 in the storage position, the boat 10 is positioned with its gunwales generally parallel to the stern of the mother vessel 12, as shown in FIG. 1, with its stern 11 generally adjacent lifting arm 92. Attachment fingers 28 of boat connectors 18 and 20 respectively are then connected to brackets 34 and 44 on the gunwale of the small boat 10 by tightening wing nuts 42. Lifting arm 92 is then lowered by means of winch 150, shown in FIG. 8, to the position shown in FIG. 1 and hook 104 of link 102 is connected to pin 78 of motor mount 52 as shown in FIG. 4. The cable 152 is then wound on winch 150 until lifting arm 92 is in the vertical position and hinged section 80 of motor mount 52 contacts stop 107 of arm 106 as shown in FIGS. 5 and 7. The small boat 10 is thus tilted upwards 90° about pins 26 of boat connector 18 and 20 and motor mount 52 remains in the generally horizontal position because of the pivoting of pivoting connector 54 about pin 64 and the pivoting of pin 78 relative to hook 104 of link 102. When arm 92 is in the upright position, as shown in solid lines in FIG. 2, pin 84 is received in slot 114 of arm 106 and is tightened in position by means of allen wrench 132 tightening pin 84 as shown in FIG. 5. By unscrewing screw 83 from tab 79, and thus disengaging untapped end 85 from hollow end 87 of pin 78, the motor mount 52 is free to pivot about hinge 82. Motor mount 52 is then disconnected from pivoting connector 54 by loosening bolt 60 and disengaging it from aperture 73 of tab 71 as shown in FIG. 6. When motor mount 52 has been disconnected from pivoting connector 54, it is rotated 90° about hinge 82 to the position parallel to the stern of the mother vessel 12 as shown in solid lines in FIG. 2. Bolt 142 is then tightened until it projects through slot 70 on motor mount 52 to secure the motor mount 52 in position. It should be noted that the small boat 10 is no longer connected to the lifting arm 92 at this point and should be secured to the mother vessel by means of a cable or suitable retaining strap as shown in FIG. 10. Strap 201 has rectangular aperture 202 at one end for receiving projection 204 attached to small boat seat 206 by screws 208. The other end of strap 201 is hingedly connected to angle section 210 by pin 212. Brace 213 connects section 210 and strap 201. A bracket 216 is connected to the other end of section 210 by hinge 218. Bracket 216 has screw holes for securing the unit to the stern of the mother vessel. The unit is shown in FIG. 1 in the closed condition against the stern of the mother vessel. The lower gunwale of the small boat in the storage position can be brought closer to the stern of the mother vessel by moving pin 26 along elongate slot 27 to reside in a depression closer the stern.

To lower the small boat 10, and to place the outboard 200 in the operational position on the stern 11 of the small boat 10, the above procedure is reversed. After removing strap 201 from projection 204 as shown in FIG. 10, the bolt 142 on arm 105 of bracket 101 is loosened until it disengages from slot 70 in motor mount 52. The motor mount 52 is then swung around on hinge 82 to the position shown in dotted lines in FIG. 2. Thumb screw 83 is tightened until untapped end 85 engages with hollow end 87 of pin 78. With lifting arm 92 in the raised position, pin 78 is in place in slot 104 of link 102 and pin 84 is located in slot 114 of arm 106. Motor mount 52 is then connected to pivoting connector 54 by means of bolt 60 and projections 65 and 66 fitting into apertures 61 and 63 as shown in FIGS. 1, 2 and 6. Pin 84 is loosened from nut 126 using allen wrench 132 as shown in FIG. 5, releasing pin 84 from V-shaped slot 114. Lifting arm 92 is then lowered from the vertical position shown in FIG. 2 to the horizontal position shown in FIG. 1 by means of winch 150 as shown in FIG. 8. Small boat 10 is thus rotated to the position in the water shown in FIG. 7. To disconnect the small boat 10, wing nuts 42 on bolts 40 of brackets 34 and 44 are loosened and boat connectors 18 and 20 disconnected. Hook 104 of link 102 on lifting arm 92 is also disconnected from pin 78 of motor mount 52. The small boat 10 may then be used in the normal manner.

Although the above described apparatus can be made of other suitable materials, stainless steel is preferred because of its durability and corrosion resistance, particularly for use in salt water.

What I claim is:

1. An apparatus for simultaneously moving an outboard motor and small boat between a storage position generally against a mother vessel and an operational position floating generally adjacent the mother vessel, the apparatus comprising:

a mount for the outboard motor;

first connecting means for pivotally connecting the mount to the small boat;

lifting arm means having a proximal end and a distal end and pivotally connectable to the mother vessel near the proximal end;

second connecting means near the distal end of the lifting arm means for pivotally connecting the lifting arm means to the mount; and;

lifting means for lifting the lifting arm means from a lowered position to a raised position and for lifting the mount from the operational position to the storage position when the mount is connected to the lifting arm.

2. An apparatus as claimed in claim 1, including securing means locatable on the mother craft, generally adjacent the distal end of the lifting arm means when the lifting arm means is in the raised position, for securing the mount to the mother craft after the mount is raised to the storage position.

3. An apparatus as claimed in claim 2, wherein:

the mount has a first end and a second end, the mount being pivotally connectable to the stern of the small boat near the first end for pivotal movement away from or towards the stern of the small boat in a generally vertical plane, and being pivotally connectable to the lifting arm means near the second end for pivoting in the generally vertical plane.

4. An apparatus as claimed in claim 3, wherein the securing means comprises a bracket attachable to the mother craft and having a first means for securing the motor mount near the first end of the motor mount and a second means for securing the motor mount near the second end of the motor mount so the motor may be held in a generally upright storage position on the mount and generally adjacent the mother craft.

5. An apparatus as claimed in claim 4, including hinge means between the first and second end of the mount generally adjacent the second end of the mount, whereby, after the mount is secured by the second securing means near the second end of the mount, the first end of the motor mount may be moved towards, and secured by, the first securing means.

6. An apparatus as claimed in claim 5, wherein the lifting arm means is a lifting arm pivotally connectable to the stern of the mother vessel generally near the water line, and is liftable by the lifting means from the lowered position, where the arm is generally perpendicular to the stern, to the raised position, where the lifting arm is generally parallel to the stern and generally vertical.

7. An apparatus as claimed in claim 6, wherein the lifting arm includes a connecting link pivotally connectable generally near the distal end of the lifting arm and near a first end of the link for pivoting in the generally vertical plane, and pivotally connectable to the mount generally near the second end of the mount and generally near a second end of the link for pivoting in the generally vertical plane.

8. An apparatus as claimed in claim 7, wherein the mount and the link are pivotally connectable by means of a hook engageable with a pin.

9. An apparatus as claimed in claim 7, wherein the lifting arm is connectable to the mount, or disconnectable from the mount, when the lifting arm is in the lowered position and the mount is in position on the small boat.

10. An apparatus as claimed in claim 9, wherein the first and second means of the bracket comprise first and second bracket arms, respectively, extending generally perpendicular to the stern of the mother craft.

11. A combination of:

an apparatus as claimed in claim 6, wherein the lifting arm is pivotally connectable to the stern of the mother craft generally near the water line and to one side of the stern; and boat connecting means for hingedly connecting a gunwale of the small boat to the stern of the mother vessel when the gunwale is generally parallel to the stern of the mother vessel and the stern of the small boat is generally adjacent the lifting arm, whereby the small boat is rotated generally 90° from a floating position adjacent the stern of the mother vessel to a storage position generally against the stern of the mother vessel and an outboard motor mounted on the mount is lifted in a generally upright orientation from the position on the small boat to a position on the mount generally adjacent the securing means, when the lifting arm means is connected to the mount and lifted from the lowered position to the raised position.

12. In combination:

two spaced apart boat connectors attachable to a mother craft, each boat connector having means for connecting the boat connector to a gunwale of a small boat floating adjacent the mother craft with the gunwale of the small boat generally parallel to the stern of the mother craft, each boat connector having a hinge whereby the small boat may be rotated upwards about the hinges generally 90° to a storage position against the stern of the mother craft; and an apparatus for lifting an outboard motor in a generally upright orientation from an operational position on the stern of a small boat to a storage position against the stern of the mother craft, the apparatus comprising: a mount for the outboard motor connectable near a first end of the mount to the stern of the small boat, the mount being pivotable generally about the first end of the mount in a generally vertical plane when connected to the small boat, and the mount having a second end; a lifting arm pivotally connectable to the mother craft near a proximal end of the lifting arm, and generally near the water line at the stern of the mother craft, for pivoting in the generally vertical plane, the lifting arm having a distal end detachably and pivotally connectable to the motor mount near the second end of the motor mount, for pivoting in the generally vertical plane, and means for lifting the lifting arm from a lowered position, where the mount is in position on the stern of the small boat, to a raised position, where the distal end of the lifting arm is generally above the proximal end of the lifting arm and generally adjacent the stern of the mother vessel, so that, as the lifting arm is raised from the lowered position to the raised position, while the distal end of the arm is connected near the second end of the mount, the mount pivots away from the stern of the small boat about the first end of the mount and remains generally horizontal and the small boat is rotated from the floating position to the storage position.

13. A combination as claimed in claim 12 including a bracket connectable to the stern of the mother vessel generally adjacent the distal end of the lifting arm when the lifting arm is in the raised position, the bracket having a first bracket arm with means for securing the mount near the first end of the mount and a second bracket arm for securing the mount near a second end of the mount, the mount having a hinge generally near the second end of the mount whereby the second end of the mount may be secured to the second bracket arm when the lifting arm is in the raised position and then the first end of the mount may be swung towards the first bracket arm about the hinge and then secured to the first bracket arm.

* * * * *